US006286500B1

(12) United States Patent
Jones

(10) Patent No.: US 6,286,500 B1
(45) Date of Patent: Sep. 11, 2001

(54) HEATERS

(75) Inventor: David Mervin Jones, Copthorne (GB)

(73) Assignee: Philomena Joan Jones, Copthorne (GB)

( * ) Notice: Subject to any disclaimer, the term of this patent is extended or adjusted under 35 U.S.C. 154(b) by 0 days.

(21) Appl. No.: 09/402,810

(22) PCT Filed: Apr. 9, 1998

(86) PCT No.: PCT/GB98/01070

§ 371 Date: Dec. 23, 1999

§ 102(e) Date: Dec. 23, 1999

(87) PCT Pub. No.: WO98/46946

PCT Pub. Date: Oct. 22, 1998

(30) Foreign Application Priority Data

Apr. 11, 1997 (GB) ..... 9707396

(51) Int. Cl.[7] ..... F24C 15/22

(52) U.S. Cl. ..... 126/91 A; 126/92 B; 126/89; 126/116 R

(58) Field of Search ..... 126/91 A, 92 B, 126/116 R, 91 R, 89, 85 R

(56) References Cited

U.S. PATENT DOCUMENTS

| | | | | |
|---|---|---|---|---|
| 1,639,114 | * | 8/1927 | Smith . | |
| 2,759,472 | * | 8/1956 | Cartter | 126/92 B |
| 3,279,455 | * | 10/1966 | Corey | 126/92 B |
| 4,727,854 | * | 3/1988 | Johnson | 126/92 B |
| 5,044,353 | * | 9/1991 | Mizuno et al. | 126/91 A |
| 5,626,125 | * | 5/1997 | Eaves | 126/91 A |

FOREIGN PATENT DOCUMENTS

| | | | | |
|---|---|---|---|---|
| 30394 71 | | 1/1973 | (AU) . | |
| 36 30 098 | | 3/1988 | (DE) . | |
| 3903540 | * | 8/1990 | (DE) | 126/92 B |
| 408396 | * | 1/1991 | (EP) . | |
| 408397 | * | 1/1991 | (EP) . | |
| 410707 | * | 1/1991 | (EP) . | |
| 408396 | * | 6/1991 | (EP) | 126/91 A |
| 2145218 | * | 3/1985 | (GB) . | |
| 62-182533 | * | 8/1987 | (JP) | 126/91 A |
| 1-123950 | * | 5/1989 | (JP) | 126/91 A |
| 5-39924 | * | 2/1993 | (JP) | 126/91 A |
| WO 95 32399 | | 11/1995 | (WO) . | |
| WO96/10720 | * | 1/1996 | (WO) . | |

* cited by examiner

*Primary Examiner*—Carl D. Price
(74) *Attorney, Agent, or Firm*—Lahive & Cockfield, LLP

(57) ABSTRACT

A space heater capable of providing both radiant and blown warm air heating to a space beneath the heater. The heater comprises a housing, the underside of which is recessed to define a channel in which a combustion tube is mounted. The heater has a burner communicating with a first end of the tube, and a first fan means communicating with the tube for moving combustion gases along the tube from the first end to the second end. The housing includes an aperture in an upper surface thereof. The aperture is linked to a second fan means for directing air into the channel within the housing. A heat exchanger plate is mounted between the tube and the aperture. The heat exchanger plate is shaped to surround the upper surface of the combustion tube so as to absorb radiation therefrom and to prevent air from the aperture from impinging directly onto the tube. Air is heated by the heat exchanger plate before passing out downwardly through a lower end of the channel within the housing.

16 Claims, 4 Drawing Sheets

HEATERS

BACKGROUND OF THE INVENTION

This invention relates to heaters and in particular space heaters of the type intended to heat large buildings such as warehouses, factories, hangars etcetera.

Space heaters are known from inter alia, WO-A-96/10720, GB-A-2 145 218, EP-A-0 408 396, EP-A-0 408 397, and EP-A-0 410 707. The heaters disclosed in EP-A-0 408 396 comprise a housing, an elongate combustion tube, a burner at one end of the tube and a fan at the other end of the tube for drawing combustion gases through the tube. The housing is open at its lower end to permit radiant heat from the combustion tube to be directed downwardly from the heater towards the ground. In addition to providing radiant heating, the heater disclosed in EP-A-0 408 396 is also arranged to provide blown warm air heating. This is achieved by providing an air duct which passes along the interior of the housing such that the air inside is warmed as it moves along the air duct, apertures in the air duct allowing the warm air to escape in a downwards direction. In addition, at the air inlet a proportion of the air can be diverted by deflector plates such that the air impinges directly onto the combustion tube thereby providing a faster rate of heating of the air before it passes out through the bottom of the heater towards the ground. The positions of the deflector plates can be varied so as to divert more or less air directly on to the combustion tube so as to achieve a desired balance between the radiant heat and the convected heat emitted by the heater.

One consequence of directing air on to the combustion tube directly is that it cools the tube which can lead to loss of radiant efficiency and can also cause the formation of soot and condensation within the combustion tube. A further potential disadvantage of the heater disclosed in EP-A-0 408 396 is that there is only a single centrifugal fan at one end of the heater and hence it is difficult to ensure that the output of heated fan-assisted convected air from the heater remains at a useful and constant level along the length of the heater; particularly in heaters of longer length.

SUMMARY OF THE INVENTION

The present invention overcomes the aforesaid problems by providing one or more fans located on top of the heater housing and arranged to draw external air down through the heater housing. In order to prevent the air from cooling the burner tubes with the attendant problems described above, the upper surfaces of the tubes are surrounded by thermal radiation-absorbing plates or heat exchangers which are heated by radiation from the upper halves of the tubes. The air driven through the heater by the fans on top of the heater housing is thus heated as it comes into contact with the heat exchanger plates before passing out through the lower end of the heater towards the ground.

Accordingly, in a first aspect, the invention provides a space heater capable of providing both radiant and blown warm air heating to a space beneath the heater; the heater comprising a housing, the underside of which is recessed to define a channel in which a combustion tube is mounted; the heater having a burner communicating with a first end of the tube; and first fan means communicating with the tube for moving combustion gases along the tube from the first end to a second end thereof; the housing having an aperture in an upper surface thereof, the aperture being linked to second fan means for directing air into the channel within the housing; and a heat exchanger plate mounted between the tube and the aperture, the heat exchanger plate being shaped so as to surround the upper surface of the tube so as to absorb radiation therefrom and to prevent air from the aperture from impinging directly onto the tube; whereby the air is heated by the heat exchanger plate before passing out downwardly through the lower end of the channel.

The recessed underside of the housing can have only one combustion tube mounted therein, or it can have a plurality of combustion tubes mounted therein, for example, two, three or four combustion tubes. Where there is a plurality of combustion tubes, the tubes can be mounted, for example, in a side by side manner.

In one particular embodiment of the invention, there is only a single combustion tube.

The or each combustion tube can comprise two or more limbs, a main first limb being connected at one end to the burner and being connected at an end remote from the burner to one or more return limbs which is or are substantially parallel to the main first limb. In one preferred embodiment, the combustion tube comprises a main first limb and a pair of return limbs each linked to the main first limb at an end remote from the burner, the two return limbs being arranged either side of the main first limb.

Where there is more than one return limb, the main first limb is typically of greater cross-sectional area than the return limbs. For example, where there are two return limbs, the volume of the main first limb can be approximately twice that of the individual return limbs.

The return limb or limbs can each have a fan, for example a centrifugal fan, attached thereto for drawing combustion gases along the first limb and into the or each return limb.

The second fan means preferably comprises a fan mounted on top of the housing. The second fan means can comprise a plurality of fans mounted at spaced apart locations along the top of the housing. The fans advantageously are axial fans. The air directed by the second fan means into the channel typically is air from the exterior of the housing. Advantageously, the air drawn into the housing by the second fan means can be preheated, for example by passing it through a heat exchanger to remove heat from the exhaust gases arising from the combustion process. This can be accomplished for example by using a balanced flue system.

The housing can comprise inner and outer skins, the inner skin defining the walls of the channel and the outer skin defining the upper surface of the housing, the space between the inner and outer skins being at least partially filled with thermal insulating material. The thermal insulating material is preferably one which is capable of resisting temperatures in excess of 500° C., and in particular temperatures above 600° C.

The inner surface of the channel within the housing, e.g. the inner skin, preferably has a reflective surface so as to reflect thermal radiation from the combustion tubes in a downwards direction, or to reflect any thermal radiation from the heat exchanger plates back onto the plates. In order to improve the reflective efficiency of the reflective surfaces of the channel, the reflective surfaces are preferably surfaces which have been treated to reduce surface porosity and unevenness and improve reflectance. For example, the surfaces may be of anodised aluminium, and in particular may be formed of a coloured anodised aluminium, most preferably a gold coloured anodised aluminium. Gold coloured anodised aluminium is considered to be particularly efficient at reflecting radiation in the context of the heaters of the present invention.

By contrast, the under surface of the heat exchanger plate, and preferably also the upper surface, is usually substantially non-reflective, and can advantageously be treated to improve its radiation-absorbing properties. For example, the under surface can be blackened. Alternatively, or additionally, the surfaces of the heat exchangers can be treated to increase their surface area, for example by shot or bead blasting to create craters and pits in the surface.

The radiation emitted by a hot body is related to the temperature of that body by a power law and if follows that increased efficiency can be obtained from a radiant heater by running it such that the heating element, i.e. the combustion tube, is as hot as possible. One limiting factor, however, on the efficiency of the heater, is the formation of "hot spots" on the surface of the heater, where the flame comes into direct contact with the wall of the tube. If the combustible mix is adjusted to provide a higher running temperature, the number and temperature of such hot spots increases, eventually leading to failure of the element. In order to overcome this problem, the combustion tube can have an inner liner which extends from the burner end of the tube along the interior of the tube into which the combustible mix is supplied, the liner having a smaller cross-section than the combustion tube and being perforated. Thus, the flame can be retained within the liner but supplied with air from the region between the liner and the inner wall of the combustion tube, which can enter the liner via the perforations. Since the problem of hot spot formation is at its most severe at the end where the combustible mix is supplied, but is less so or negligible at the distant end of the elongated combustion tube, it is not necessary for the liner to extend along the whole length of the combustion tube. Indeed, it is preferred that the liner is shorter than the tube to reduce cost and simplify construction.

The liner can be provided with a flared portion which extends out of the combustion tube and into which the combustible mix is directed. Thus, the combustible mix is more easily directed into the liner, and a positive gap can be left between the flared portion and the inlet to the combustion tube to allow air into the combustion tube. By virtue of the liner, since the flame is kept separate from the wall of the heating element, the flame temperature can be increased resulting in increased efficiency.

If desired, in order to improve the efficiency of the heater, the air supply to the burner can be heated prior to mixing by being directed past the combustion tube. Thus, less heat is wasted in raising the inlet air to the temperature of the flame, and accordingly the flame can be run more efficiently.

In another aspect, the invention provides a space heater as herein before defined but which is of modular form and comprises a pair of end modules and one or more intermediate modules, the end modules and intermediate modules being connectable together to form the heater; at least one of the end modules having a burner mounted thereon, and at least one of the end modules having a first fan means, as hereinbefore defined, mounted thereon; the or each intermediate module comprising an intermediate portion of the housing having mounted therein an intermediate portion of the combustion tube and the heat exchanger plate, the intermediate portion of the housing having an aperture in an upper surface thereof, the aperture being linked to second fan means for directing air into the channel within the housing.

The heater may contain only one intermediate module; or two or more intermediate modules can be disposed between the proximal and distal end modules. Thus, the number of intermediate modules can be selected according to the length of the heater required.

Non fan-bearing spacer modules can also be provided, for insertion between intermediate modules or between intermediate modules and the end modules. The spacer modules can comprise a portion of the housing having mounted therein a portion of the combustion tube and the heat exchanger plate.

The end modules, intermediate modules and any spacer modules are preferably provided with cooperating formations enabling the modules to be connected together. For example, a module can be provided with one or more spigot and/or socket formations for connection to complimentary socket or spigot formations on adjacent modules.

In one embodiment, one end module can contain a burner and the other end module can contain the first fan means.

In another embodiment, the heater can have a plurality of separate combustion tubes, and one end module can contain at least one burner and at least one first fan means and the other end module can contain a complimentary number of burners and first fan means, the total number of burners and first fan means each corresponding in number to the number of combustion tubes.

In yet another embodiment, one end module can contain at least one burner and at least one first fan means and the other end module can form a manifold connecting together main first combustion tubes and return tubes as hereinbefore defined.

It can thus be seen that the modular nature of the heaters of the present invention enables a large range of heaters of different sizes and configuration to be manufactured from a relatively small number of modules.

BRIEF DESCRIPTION OF THE DRAWINGS

The invention will now be illustrated by reference to the specific embodiments shown in the accompanying drawings, of which.

DETAILED DESCRIPTION OF THE INVENTION

Figure 1:
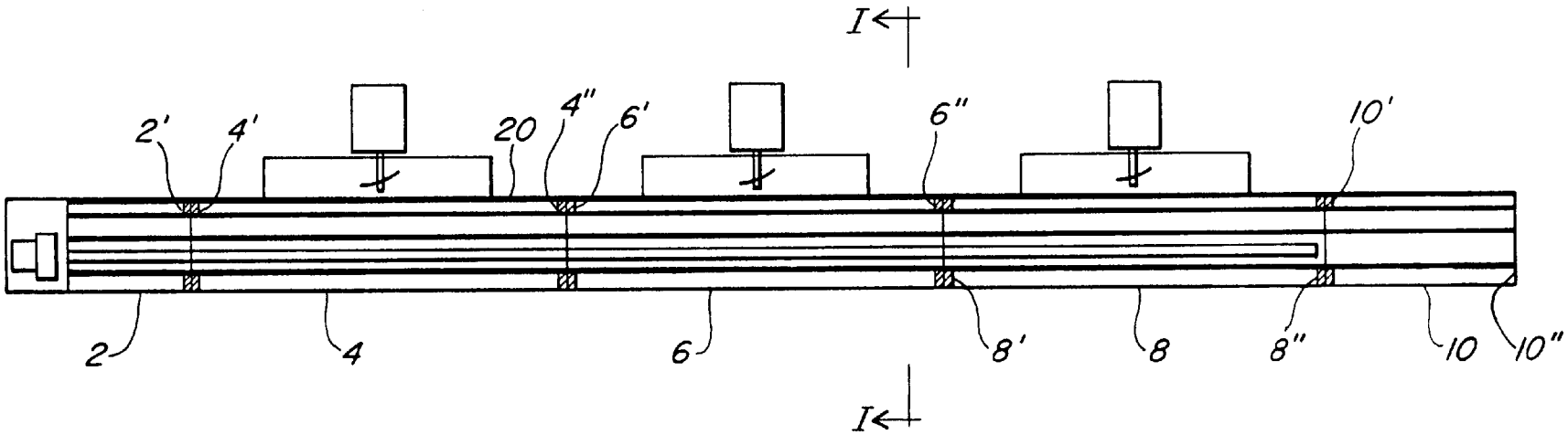
FIG. 1 is a side sectional elevation of a modular heater according to one embodiment of the invention.
Figure 2:
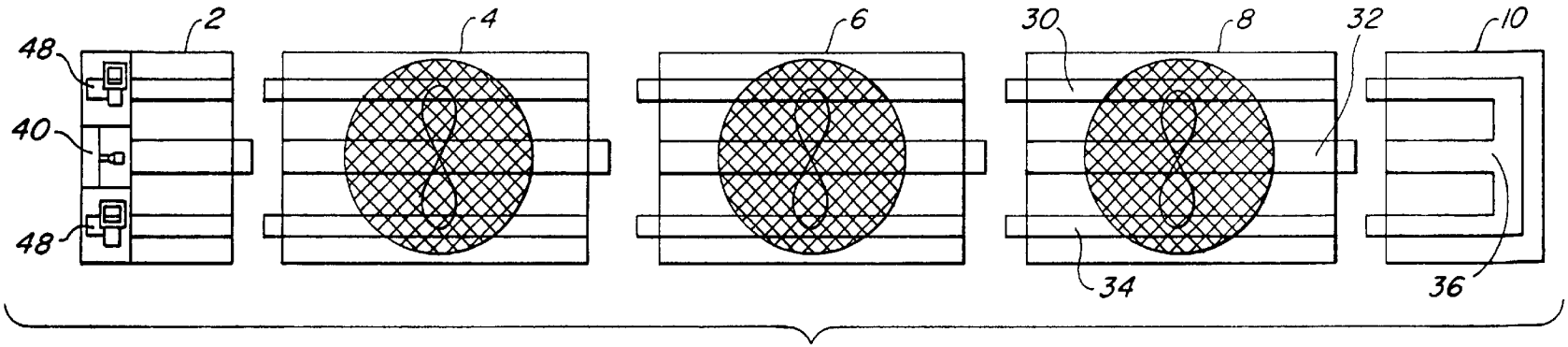
FIG. 2 is an exploded schematic view from below of the modular heater of FIG. 1.
Figure 3:
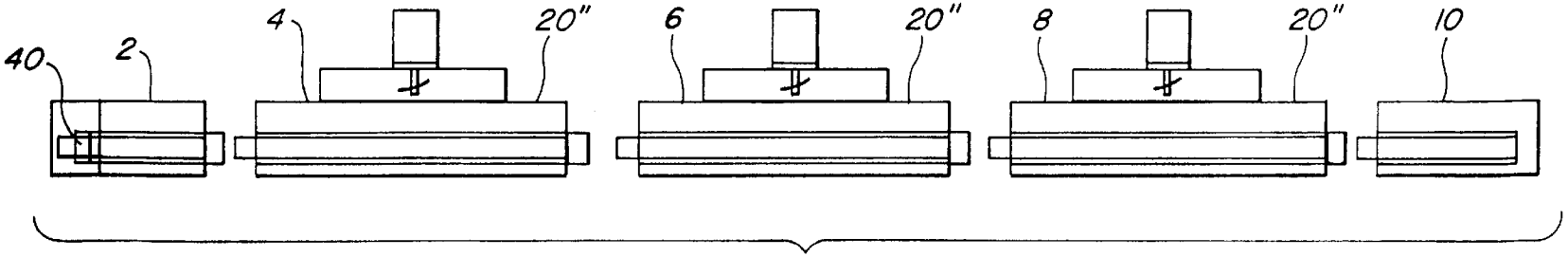
FIG. 3 is an exploded schematic view from one side of the modular heater of FIGS. 1 and 2
Figure 4B:
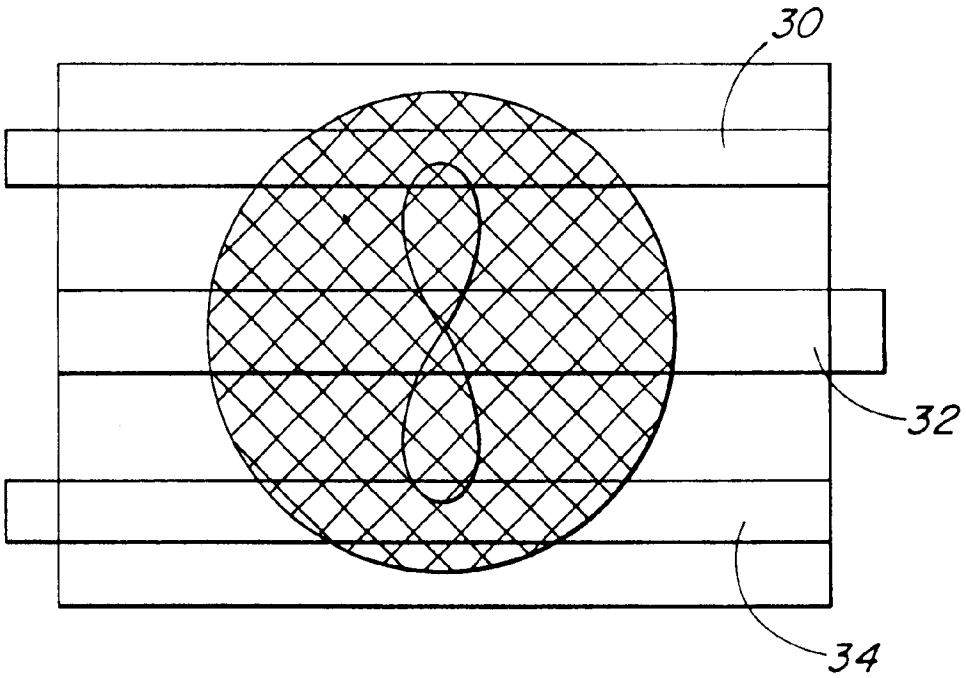
FIGS. 4*a* and 4*b* are enlarged views of a burner end module and intermediate module of the heater of FIGS. 1 to 3.
Figure 4A:
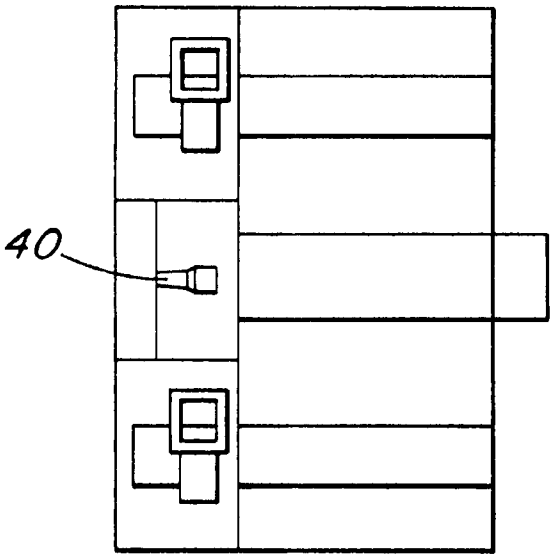
Figure 5:
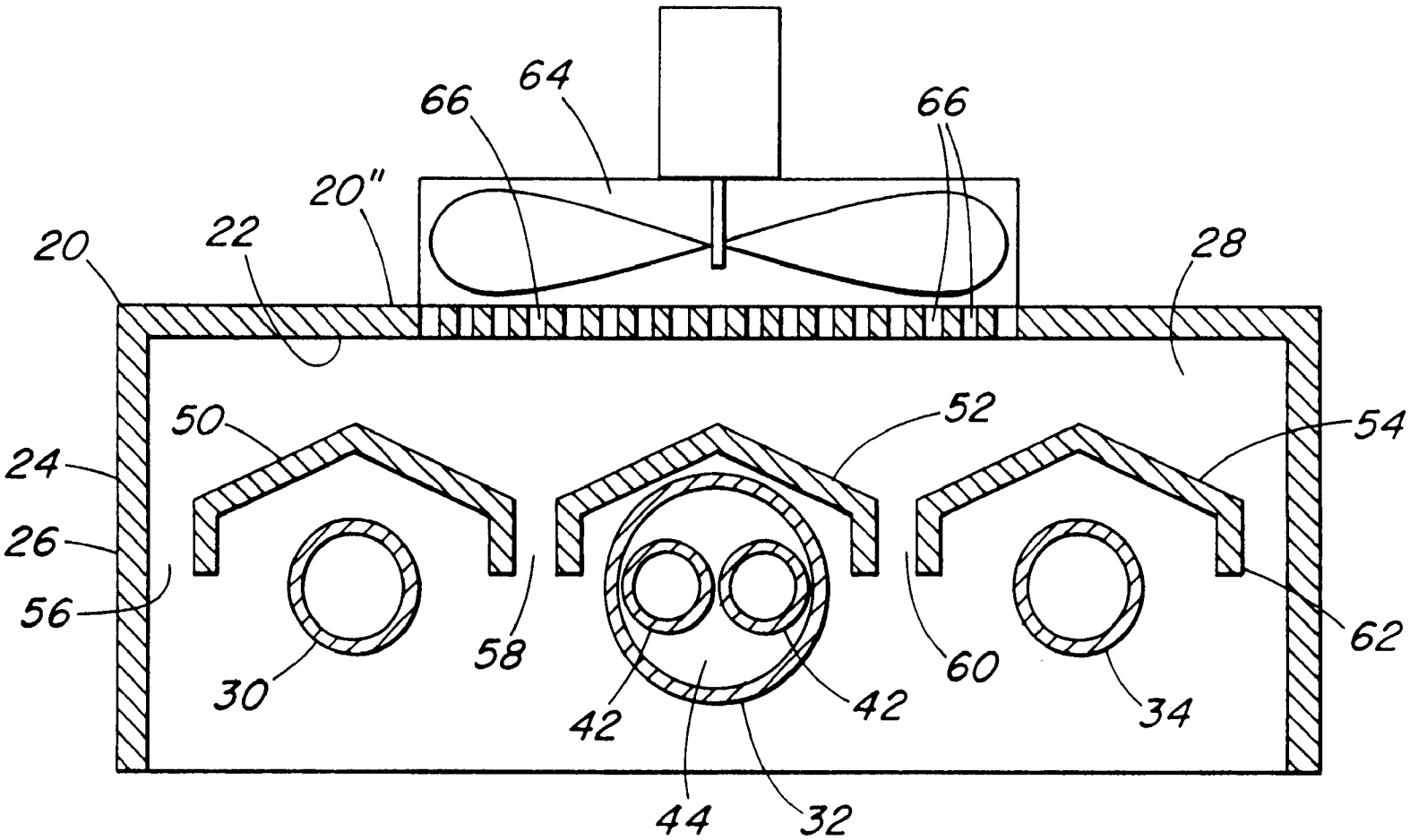
FIG. 5 is a sectional view along line 1—1 in FIG. 1.

Referring now to the drawings, a heater according to one embodiment of the invention comprises five modules, a proximal or burner end module 2, three intermediate modules 4, 6 and 8 and a distal end module 10. The five modules fit together by means of spigot and socket joints between spigot formations (shown in FIGS. 2, 3 4*a* and 4*b*) and complimentary socket formations (not shown).

When connected together, the heater comprises a housing 20 comprising inner 22 and outer 24 walls with a layer of insulating material 26 sandwiched therebetween. The housing is stiffened by the end walls 2', 2", 4', 4", 6', 6", 8', 8", 10', 10" of the four modules. The recessed underside of the housing defines a channel 28, in which are suspended three combustion tubes 30, 32 and 34 linked by a manifold 36 which is mounted in the distal end module 10. The proximal end 20 module has mounted therein a gas burner 40, which is shown schematically and can be of conventional design. The gas burner can be a single burner or there can be present a plurality of burners. The gas burner(s) outlet vents into the proximal end of the main combustion tube 32. The main combustion tube 32 has disposed therein one or two perforated liner tubes 42. With such an arrangement, air can flow along the space 44 between the outside of the liner tubes 42 and the inner wall of the combustion tube 32 passing through holes (not shown) in the liner tube walls to feed the flame as it advances along the liner tube 42. In this way, more complete combustion is achieved.

To either side of the gas burner 40 on the underside of the proximal end module 2, are mounted centrifugal fans 48 which can be of conventional construction. The centrifugal fans 48 are attached to return tubes 30 and 34 respectively. Return tubes 30 and 34 which are of approximately half the volume of the main combustion tube 32, are connected to the main combustion tube 32 at the manifold 36. The tubes 30, 32 and 34 are formed from steel, and may be surface treated to maximise their radiative efficiency.

Suspended above each of the combustion tubes so as to surround the upper halves of the tubes are thermal radiation-absorbing heat exchanger plates 50, 52 and 54 which are of downwardly open channel section. The heat exchanger plates are closely spaced so as to define gaps 56, 58, 60 and 62 of restricted width, the significance of which will be explained below. The heat exchanger plates 50, 52 and 54 are most preferably treated to increase their radiation absorbing capability. They may, for example, be blackened on at least their undersides so as to maximise their heat absorbing properties. Alternatively or additionally, they can be treated, for example by bead or shot blasting, in increase their surface areas.

On top of the housing portions 20" of each of the intermediate modules are mounted axial fans 64 which are shown schematically but can be of conventional construction. The air output of the fans 64 is directed through apertures 66 in the upper wall of the housing portion 20".

In use, gas is fed to the burner or burners 40 and combustion takes place in the main combustion tube 32. The products of combustion are drawn along the main combustion tube 32, around the manifold 36 and back along the return tubes 30, 34 to exhaust by the centrifugal fans 48 at the ends of each return tube. The combustion tubes 30, 32, 34 are thus heated to temperatures of between 300° and 600° centigrade, at which temperatures heat radiates from the surfaces of the tubes. Heat radiating from the lower surfaces of the tubes is directed towards the ground to provide a radiant heating effect.

Inevitably, the tube 32 will be hotter than the return tubes 30 and 34 and the tubes will themselves have a graduated temperature therealong. However, by positioning the return tubes 30 and 34 generally parallel to the main combustion tube 32, the average temperature of the three tubes remains substantially constant along the length of the heater. Thus, the total radiative output of the heater is substantially constant along its length.

Heat radiating from the upper surfaces of the tubes 30, 32, 34 is captured by the absorbent surfaces of the heat exchanger plates 50, 52, 54. Air driven in through the apertures 66 in the upper walls 20" of the housing by the axial fans 64 passes over the heat exchanger plates 50, 52, 54 and is heated before escaping through the restricted width gaps 56, 58, 60, 62 between the plates and downwards towards the floor below. The purpose of the restricted widths of the gaps between the heat exchanger plates is to ensure that a back pressure builds up in the space above the plates so as to ensure that there is maximum opportunity for the air to come into contact with the plates and extract heat from the plates.

Thus, the heater provides both a radiant heating effect and a fan assisted warm air heating effect. By placing heat exchanger plates over the combustion tubes, heat which would otherwise go to waste is captured and directed back down towards the floor thereby maximising the efficiency of the heater. Moreover, by shielding the combustion tubes from the air flow, unwanted cooling of the tubes, which would reduce the radiant output of the tubes and could lead to incomplete combustion, is avoided. A further advantage of the fan-assisted convection is that it draws air from the regions beneath the roof of the building which will already have been warmed to some extent and will have risen to the roof by normal convective currents. In order to further enhance the efficiency of the heater, the exhaust gases from the burner can be passed through a further heat exchanger (e.g. a balanced flue system—not shown) connected to the air inlet for the axial fans thereby further pre-heating the air before it is driven into the heater housing.

A further advantageous feature of the heaters of the present invention is their modular construction which enables heaters of varying length to be created simply by varying the number of intermediate modules. In the embodiment shown in the drawings, the heater has three intermediate modules but it could equally well have only one or two modules or even four or more modules. By virtue of the spigot and socket jointing system, the individual modules can readily be assembled on site thereby minimising the problems of transporting what would otherwise be very large heater assemblies.

It will readily be apparent that numerous modifications and alterations can be made to the heater shown in the drawings without departing from the principles underlying the invention, and all such modifications and alterations are intended to be embraced by this application.

What is claimed is:

1. A space heater capable of providing both radiant and blown warm air heating to a space beneath the heater; the heater comprising a housing, the underside of which is recessed to define a channel in which a combustion tube is mounted; the heater having a burner communicating with a first end of the tube; and first fan means communicating with the combustion tube for moving combustion gases along the tube from the first end to a second end thereof; the housing having an aperture in an upper surface thereof, the aperture being linked to second fan means for directing air into the channel within the housing; and a heat exchanger plate mounted between the combustion tube and the aperture, the heat exchanger plate being shaped so as to surround an upper surface of the tube so as to absorb radiation therefrom and the prevent air from the aperture from impinging directly on the tube; whereby the air is heated by the heat exchanger plate before passing out downwardly through a lower end of the channel; wherein the space heater is of modular form and comprises a pair of end modules and one or more intermediate modules, the end modules and the intermediate modules being connectable together to form the heater; at least one of the end modules having said burner mounted, and at least one of said end modules having said first fan means mounted thereon; each said intermediate module comprising an intermediate portion of the housing having mounted therein an intermediate portion of the combustion tube and the heat exchanger plate, the intermediate portion of the housing having one or more apertures formed in an upper surface thereof, the apertures being linked to said second fan means for directing air into the channel within the housing.

2. A space heater according to claim 1 wherein the recessed underside of the housing has mounted therein only a single combustion tube.

3. A space heater according to claim 1 wherein the recessed underside of the housing has mounted therein a plurality of combustion tubes.

4. A space heater according to claim 1 wherein the recessed underside of the housing has mounted therein one or more combustion tubes each comprising two or more limbs, said two or more limbs including a main first limb being connected at one end to the burner and being connected at an end remote from the burner to one or more return limbs which are substantially parallel to the main first limb.

5. A space heater according to claim 4 wherein the combustion tube comprises a main first limb and a pair of return limbs each linked to the main first limb at an end remote from the burner, the two return limbs being arranged on either side of the main first limb.

6. A space heater according to claim 5 wherein each said return limb has a fan attached thereto for drawing combustion gases along the main first limb and into each said return limb.

7. A space heater according to claim 4 wherein each return limb has a fan attached thereto for drawing combustion gases along the main first limb and into each said return limb.

8. A space heater according to claim 1 wherein the second fan means comprises a fan mounted on top of the housing.

9. A space heater according to claim 8 wherein the second fan means comprises a plurality of fans mounted at spaced apart locations along the top of the housing.

10. A space heater according to claim 1 wherein the air directed by the second fan means into the channel comprises air from the exterior of the housing.

11. A space heater according to claim 1 wherein the first fan means comprises a centrifugal fan.

12. A space heater according to claim 1 wherein the second fan means comprises an axial fan.

13. A space heater according to claim 1 wherein said heat exchanger plate has an under surface, and wherein the under surface of the heat exchanger plate is substantially non-reflective.

14. A space heater according to claim 1, wherein two or more intermediate modules are disposed between the end modules.

15. A space heater according to claim 14 wherein the modules are provided with one of a spigot and a socket to enable the modules to be connected together.

16. A space heater according to claim 1 wherein the modules are provided with one of a spigot and a socket to enable the modules to be connected together.

* * * * *